US005771972A

United States Patent [19]

Dewey et al.

[11] Patent Number: 5,771,972

[45] Date of Patent: Jun. 30, 1998

[54] ONE TRIP MILLING SYSTEM

[75] Inventors: Charles H. Dewey, Houston; James E. Saylor, III, Kingwood; Bruce D. Swearingen, The Woodlands, all of Tex.; Andrew MacDonald Robin, Aberdeen; Alexander William Dawson, Keith Banffshire, both of Scotland; Gregory S. Nairn, Humble, Tex.

[73] Assignee: Smith International, Inc.,, Houston, Tex.

[21] Appl. No.: 642,829

[22] Filed: May 3, 1996

[51] Int. Cl.[6] ..... E21B 7/08

[52] U.S. Cl. ..... 166/298; 166/117.5; 175/81

[58] Field of Search ..... 166/117.6, 50, 166/117.5, 313, 384, 298; 175/81

[56] References Cited

U.S. PATENT DOCUMENTS

| | | | |
|---|---|---|---|
| 1,387,447 | 8/1921 | Alford . | |
| 2,124,414 | 7/1938 | Goldman | 255/71 |
| 2,216,963 | 10/1940 | Sinclair | 166/117.6 |
| 2,334,746 | 11/1943 | Brantly | 166/117.6 |
| 3,330,349 | 7/1967 | Owsley et al. | 166/21 |
| 3,908,759 | 9/1975 | Cagle et al. | 166/117.6 |
| 4,182,423 | 1/1980 | Ziebarth et al. | 166/117.5 X |
| 4,266,621 | 5/1981 | Brock | 175/329 |
| 4,397,355 | 8/1983 | McLamore | 166/297 |
| 4,397,360 | 8/1983 | Schmidt | 175/61 |
| 4,765,404 | 8/1988 | Bailey et al. | 166/177.6 |
| 5,109,924 | 5/1992 | Jürgens et al. | 166/117.5 |
| 5,113,938 | 5/1992 | Clayton | 166/117.6 |
| 5,199,513 | 4/1993 | Stewart et al. | 175/73 |
| 5,277,251 | 1/1994 | Blount et al. | 166/117.5 |
| 5,383,522 | 1/1995 | Hailey | 166/382 |
| 5,445,222 | 8/1995 | Pritchard et al. | 166/298 |
| 5,452,759 | 9/1995 | Carter et al. | 166/117.6 |
| 5,467,819 | 11/1995 | Braddick | 166/117.6 |
| 5,474,126 | 12/1995 | Lynde et al. | 166/117.6 |
| 5,484,021 | 1/1996 | Hailey | 166/297 |
| 5,499,680 | 3/1996 | Walter et al. | 166/377 |
| 5,499,682 | 3/1996 | Sieber | 166/382 |
| 5,551,509 | 9/1996 | Braddick | 166/117.5 X |
| 5,592,991 | 1/1997 | Lembcke et al. | 166/117.6 X |
| 5,595,247 | 1/1997 | Braddick | 166/117.6 X |

FOREIGN PATENT DOCUMENTS

| | | |
|---|---|---|
| 2299105 | 9/1996 | United Kingdom . |
| 2303158 | 2/1997 | United Kingdom . |

OTHER PUBLICATIONS

*Track Master Sidetracking System;* Feb. 24, 1995; (1 Sheet).

A–Z Grant International; *Casting Sidetrack Systems;* undated; (7 pgs.).

A–Z Servco Performance Bulletin; Smith International, Inc.; 1995 (1 pg.).

*Primary Examiner*—Frank Tsay

*Attorney, Agent, or Firm*—Conley, Rose & Tayon, P.C.

[57] ABSTRACT

The mill assembly and whipstock assembly include a mill having a tapered end which engages a ramp of the whipstock assembly. The ramp includes a plurality of surfaces having different angles whereby the rate of deflection of the mill by the whipstock varies as the mill is lowered into the borehole. In particular, the ramp of the whipstock includes two surfaces having steep angles, one steep angled surface causing the mill to punch through the wall of the casing and the second steep angle surface moving the center of the mill across the wall of the casing.

44 Claims, 8 Drawing Sheets

ONE TRIP MILLING SYSTEM

CROSS REFERENCE TO RELATED APPLICATION

This invention relates to a patent application entitled Two Trip Window Cutting System, Ser. No. 572,592, filed Dec. 14, 1995.

BACKGROUND OF THE INVENTION

1. Field of the Invention

This invention relates to a method and apparatus for drilling a secondary borehole from an existing borehole in geologic formations.

More particularly, this invention comprises a tapered starter mill and whipstock combination that in one trip, can drill a deviated borehole from an existing earth borehole or complete a side tracking window in a cased borehole.

2. Background

Traditionally, whipstocks have been used to drill a deviated borehole from an existing earth borehole. The whipstock has a ramp surface which is set in a predetermined position to guide the drill bit on the drill string in a deviated manner to drill into the side of the earth borehole. In operation, the whipstock is set on the bottom of the existing earth borehole, the set position of the whipstock is surveyed, the whipstock is properly oriented for directing the drill string in the proper direction, and the drilling string is lowered into the well into engagement with the whipstock causing the whipstock to orient the drill string to drill a deviated borehole into the wall of the existing earth borehole.

Previously drilled and cased wellbores, for one reason or another, may become non-productive. When a wellbore becomes unusable, a new borehole may be drill ed in the vicinity of the existing cased borehole or alternatively, a new borehole may be sidetracked from or near the bottom of a serviceable portion of the cased borehole. Sidetracking from a cased borehole is also useful for developing multiple production zones.

Sidetracking is often preferred because drilling, casing and cementing the borehole is avoided. This drilling procedure is generally accomplished by either milling out an entire section of pipe casing followed by drilling through the side of the now exposed borehole, or by milling through the side of the casing with a mill that is guided by a wedge or "whipstock" component.

Drilling a side tracked hole through a pipe casing made of steel is difficult and often results in unsuccessful penetration of the casing and destruction of the whipstock. In addition, if the window is improperly cut, a severely deviated dog leg may result rendering the sidetracking operation unusable.

Several patents relate to methods and apparatus to sidetrack through a cased borehole. U.S. Pat. No. 4,266,621 describes a diamond milling cutter for elongating a laterally directed opening window in a well pipe casing that is set in a borehole in an earthen formation. The mill has one or more eccentric lobes that engage the angled surface of a whipstock and cause the mill to revolve on a gyrating or non-fixed axis and effect oscillation of the cutter center laterally of the edge thus enhancing the pipe cutting action.

The foregoing system normally requires at least three trips into the well in the sidetracking operation. A first stage begins a window in the pipe casing, a second stage extends the window through use of a diamond milling cutter and a third stage with multiple mills elongates and extends the window.

While the window mill is aggressive in opening a window in the pipe casing, the number of trips, such as three, to accomplish the task is expensive and time consuming.

U.S. Pat. No. 5,109,924 teaches a one trip window cutting operation to sidetrack a wellbore. A deflection wedge guide is positioned behind the pilot mill cutter and spaced from the end of a whipstock component. The shaft of the mill cutter is retained against the deflection wedge guide such that the milling tool frontal cutting surface does not come into contact with the ramped face of the whipstock. In theory, the deflection wedge guide surface takes over the guidance of the window cutting tool without the angled ramp surface of the whipstock being destroyed.

However, when a second and third milling tool attached to the same shaft as the window milling cutter and spaced, one from the other on the support shaft contacts the whipstock ramped surface, they mill away the deflection guide projection from the ramp surface. This inhibits or interferes with the leading pilot mill window cutter from sidetracking at a proper angle with respect to an axis of the cased borehole and may cause the pilot window cutting mill to contact the ramp surface of the whipstock before the pilot window cutter mill clears the pipe casing. The reamers or mills aligned behind the pilot window mill, having the same or larger diameter than the diameter of the pilot window mill, prevents or at least inhibits the window pilot mill from easily exiting from the steel pipe casing. This difficulty is due to the lack of clearance space and flexibility of the drill pipe assembly making up the one trip window cutting tool when each of the commonly supported reamer mills spaced along the shaft, sequentially contact the window in the steel casing. Hence, the sidetracking apparatus tends to go straight rather than be properly angled through the steel pipe casing.

U.S. Pat. No. 5,455,222 teaches a combination whipstock and staged sidetrack mill. A pilot mill spaced from and located on the common shaft above a tapered cutting end is, at its largest diameter, between 50 percent and 75 percent of the final sidetrack window diameter. A surface of a second stage cutter positioned on the same shaft above the pilot mill being, at its smallest diameter, about the diameter of the maximum diameter of the pilot mill, and being, at its largest diameter, at least 5 percent greater in diameter than the largest diameter of the pilot mill.

A surface of a final stage cutter mill, also mounted on the same shaft, being at its largest diameter, about the final diameter dimension, and at the smallest cutting surface diameter, being a diameter of at least about 5percent smaller than the final diameter dimension.

The sidetracking mill is designed to accomplish the milling operation in one trip. The mill however, tends to go straight and penetrate the ramped surface of the whipstock. Substantial damage to the whipstock occurs and sidetracking may not occur as a result.

While the intent is to perform a sidetracking operation in one trip, difficulties often arise when attempting to deviate the drill string from its original path to an off line sidetracking path. Progressively larger in diameter reaming stages to enlarge the window in the steel pipe casing inhibits the drill shaft from deviating or flexing sufficiently to direct the drill pipe in a proper direction resulting in damage to the whipstock and misdirected sidetracked boreholes. In other words, the sidetracking assembly tends to go straight rather than deviating through the steel pipe casing.

SUMMARY OF THE INVENTION

It is an object of this invention to provide a one trip cutting system for cutting a deviated hole in an existing earth borehole.

It is another object of this invention to provide a one trip window cutting system for cutting an opening in a pipe casing for subsequent side tracking drilling operations.

More specifically, it is an object of this invention to provide a combination apparatus which includes a window cutting mill and a whipstock. The mill has a tapered cutting end which matches the ramp angle of the whipstock face such that in operation, as the drill string is rotated downwardly, the face of the whipstock forces the tapered cutting end of the window mill out through the pipe casing. The angled face of the whipstock adjacent to the window cutting mill and the cutter mill itself is hardfaced to minimize damage to both the whipstock and the cuter mill.

A one trip side track window cutting apparatus for cutting sidetracking windows in a pipe casing positioned in previously drilled boreholes consist of a window cutting mill affixed to an end of a shaft, a body of the mill forming a tapered cutting end.

A whipstock forms a ramp, the angle of which substantially parallels an angle of the tapered cutting end of the window mill. The ramp acts as a bearing surface for laterally forcing the window mill into the pipe casing. The face of the whipstock changes the rate of deflection of the window mill into the pipe casing.

The whipstock upstream end is ramped about 15° to match a 15° taper at the end of the window mill cutter. The whipstock upper end is attached to the end of the window mill cutter at the 15° interface through a shear bolt extending from a blade of the window mill for installation of the whipstock in a cased borehole. The end of the whipstock is heavily hardfaced, especially adjacent the interface with the window cutter mill. Another mill is positioned upstream of the window mill on the same supporting shaft and is preferably the same diameter as the window mill. When the shear bolt is sheared through an upward force on the drilling string after the whipstock is anchored and properly oriented in the cased borehole, the hardfaced ramp formed by the end of the whipstock forces the window mill immediately into the wall of the casing. Simultaneously, the second mill spaced from the window mill is forced into the casing thus starting two openings in the casing. The whipstock face below the 15° ramp parallel the walls of the casing for a distance to allow both the window mill and the second mill to cut the window started by the initial 15° ramp. As the window cutting process proceeds, the ramp surface of the whipstock transitions into a "normal" 3° ramp for a sufficient distance for the window mill to extend about half way out of the casing where the ramped surface of the whipstock transitions again to a more aggressive angle to further urge the window mill out of the casing.

Once the window mill is centered on the wall of the casing, further cutting becomes difficult because of the reduced rotation of the cutting edges at the center of the tapered window mill. At the exact center of the tapered window mill, there is essentially zero rotation. Thus, in the prior art, it took a long cutting time to have the window mill move and cut past its center line. On a standard 3° whip face, it often took a drilling length of plus or minus ten inches to have the center line of the window mill cross the wall of the casing. Very slow drilling progress is made during this period of time because the window mill is attempting to cut the wall of the casing with essentially zero rotation at the center of the window mill.

It is advantageous for all of the mills to be full gage. One advantage is that with your window mill being full gage, the window hole will also be full gage when drilling is stopped with the assembly. If the window mill is under gaged, then when the drilling bit is run into the well, the full gage drilling bit is going to slow down as it cuts the under gage borehole to full gage. This then slows down the operator's ability to kick off and drill the new borehole with the drilling bit. The drilling bit must remount the bottom section of the borehole cut by the window mill. If the hole is full gage, they will be able to use the whip to help build an angle faster and apply weight to the drilling bit to drill laterally the new borehole. If they have to go down and remount the hole, then they are much further down in the hole before they can kick out for their lateral drilling.

The window mill tapers conform to most of the ramp angles formed by the whipstock. For example, the largest diameter of the window mill forms a 3° cutting section matching the 3° section of the whipstock below the cylindrical portion of the whipstock. Of course, the 15° angle of the window mill is parallel to the, 15 formed at the top of the whipstock. These matching angulations minimize damage to the whipstock face during the window cutting process thereby assuring a successfully cut window in the casing of the borehole.

After both the window mill and the second mill cut completely through the casing, the window mill is tripped out of the borehole. The sidetracking drilling operation then commences.

An advantage then of the present invention over the prior art is the use of a tapered window mill with a surface contour matching the ramp angle formed at the upstream end of the whipstock such that the mill is forced into the casing immediately after the window mill is released from the whipstock without damage to the whipstock.

Another advantage of the present invention over the prior art is the formation of angled and parallel ramp surfaces formed on the whipstock to facilitate and enhance the cutting action of both the window mill and the second mill, upstream of and spaced from the window mill.

Still another advantage of the present invention over the prior art is the use of an acutely angled ramp section at a point along the ramped whipstock surface when the center of the window mill reaches the inside diameter of the wall of the casing resulting in a slowdown in the window cutting operation. The "kick out" ramp more quickly moves the tapered window mill past this phase of the window cutting process thus speeding up the completion of the sidetrack window.

BRIEF DESCRIPTION OF THE PREFERRED EMBODIMENTS

Figure 1:
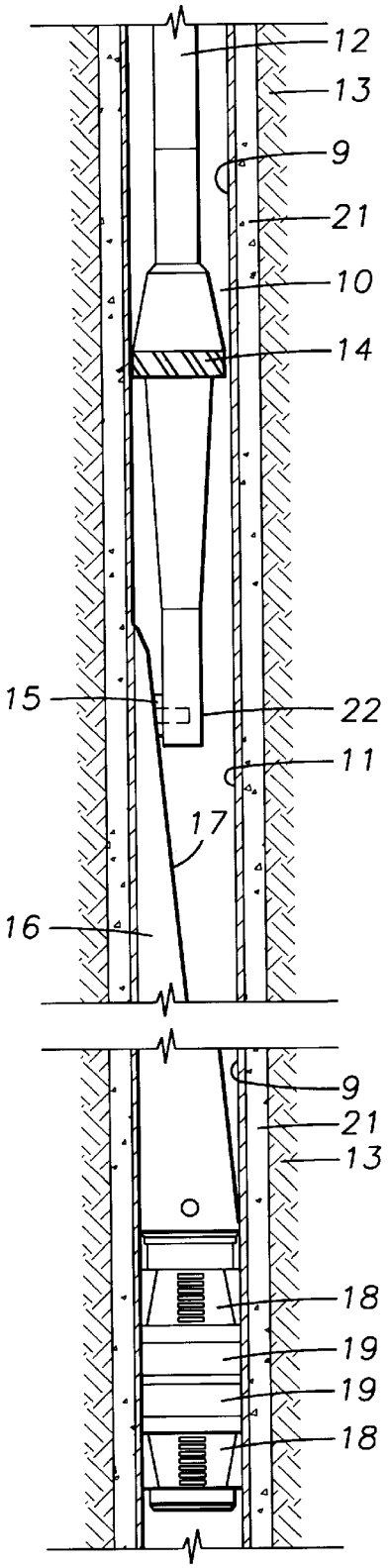
FIG. 1 (PRIOR ART)
FIG. 1 is a partial cross-sectional view of a prior art sidetracking operation depicting setting an anchor for a typical whipstock sidetracking system in a cased borehole.

Referring now to the prior art of FIG. 1, the casing sidetrack system generally designated as 10 consists of a drill collar 12 attached to a starter mill 14. The starter mill 14 is affixed to the end of the whipstock 16 through a shear bolt block 15. The whipstock 16 has an anchor 18 attached to the downhole end of the whipstock. The entire assembly 10 is tripped into a cased borehole 9. After the sidetracking system reaches a desired depth in the borehole, the whipstock 16 is oriented to a desired sidetrack angulation and set or anchored in the steel pipe casing 11. Casing 11 generally is made of steel but may be made of various other materials such as fiberglass as for example.

Figure 2:
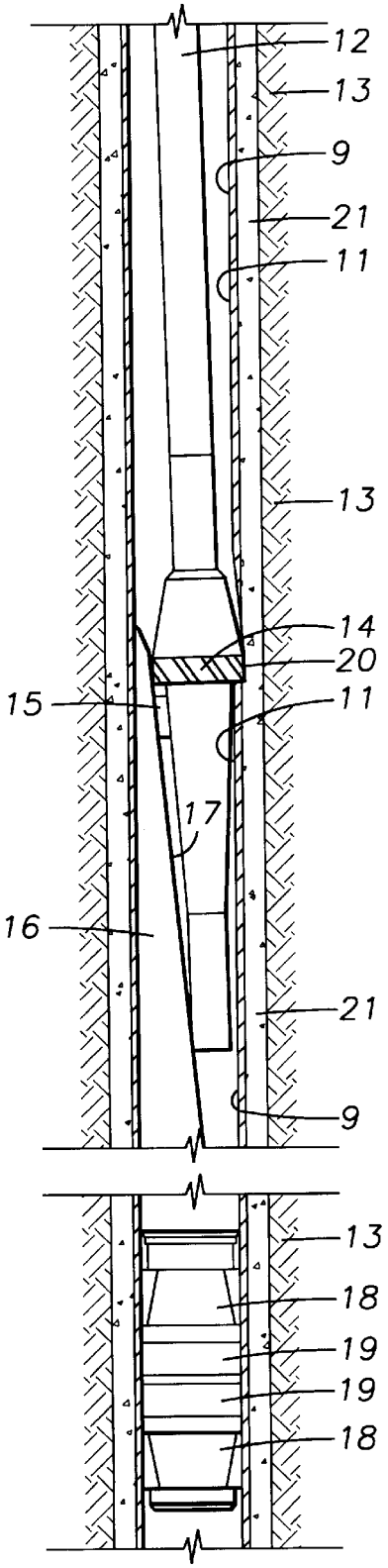
FIG. 2 (PRIOR ART)
FIG. 2 is a partial cross-sectional view of a first stage of the prior art sidetracking operation illustrating cutting a window section in a pipe casing with a typical starter mill.
Figure 3A:
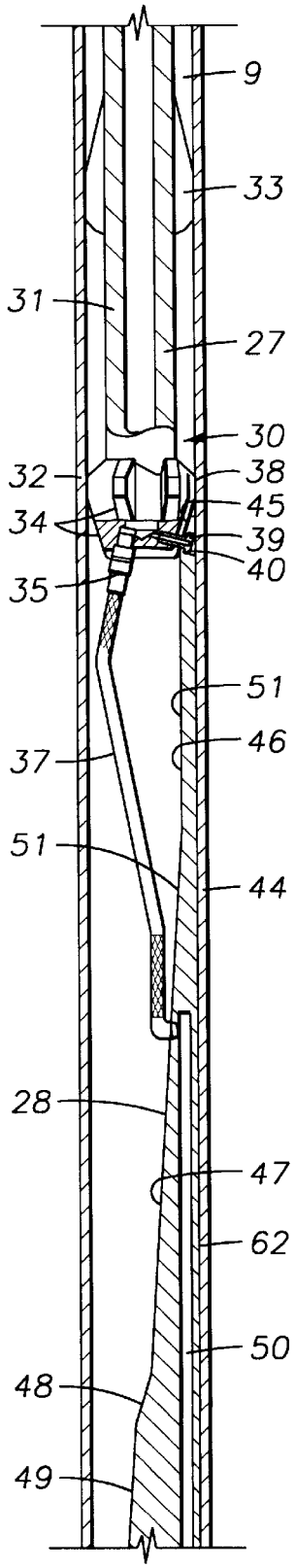
FIGS. 3A and B are a partial cross-section of a preferred embodiment of the invention whereby the top of the whipstock matches the taper of the window mill.
Figure 3B:
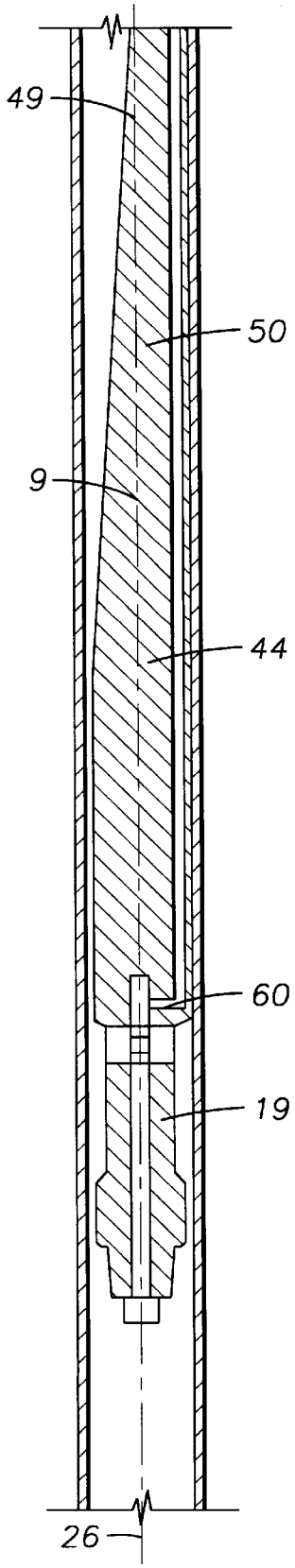

With reference to the prior art of FIG. 2, once the system 10 is properly oriented and set in the casing 11, the starter mill 14 is released from the end of the whipstock 16 by breaking the solid shear pin 22 secured to the bolt block 15. The starter mill 14 is subsequently directed into casing 11 by shear bolt block 15 along ramped surface 17 formed by whipstock 16. The starter mill 14 then mills a window 20 through the wall of the casing 11. After the starter mill 14 begins the window 20, it is tripped out of the cased borehole 9.

Turning now to the preferred embodiments represented in FIG. 3 through 11, FIG. 3 illustrates a one trip mill assembly generally designated as 30 and a whipstock assembly generally designated as 60. The mill assembly 30 includes a tapered window mill generally designated as 32. The mill 32 is attached to the bottom end of a shank or shaft 31. Upstream and spaced from the window mill is, for example, a second mill 33 also mounted to the shaft 31. The upstream end of the shaft 31 is either threadably connected to a drill string or threaded to another subassembly (see FIGS. 9 through 11). A tubular member 27 may form the shaft 31 on which mills 32 and 33 are mounted. Tubular member 27 may include a lower reduced diameter portion on which mill 32 is disposed with mill 33 being disposed on the full diameter of tubular member 27. This reduction in diameter provides flexibility between mills 32, 33 during the milling process.

A third mill may be mounted to a shaft upstream of second mill 33. The third mill is desirable in some circumstances and will be discussed in detail with respect to FIGS. 9, 10 and 11.

The window mill 32 includes a plurality of blades, such as blade 38, having a particular cutting profile which forms three cutting surfaces. The lower tapered end 52 of the window mill 32 is tapered, for example, 15° with respect to the axis 29 of the casing 11 in the borehole (more clearly shown in FIG. 4). The taper may be in the range of 1 to 45 degrees. The end surface 45 of the whipstock, generally designated as 44, is profiled (angle 15°) to match the angle of the lower tapered end 52 of the window mill (15 degrees). A shear pin 39 anchors the tapered window mill 32 through a connection in blade 38 of the mill 32 to profiled surface 45 of the whipstock 44.

Window mill 32 further includes a medial cutting surface 43 with a reduced taper of 3° which conforms to the 3° tapers on the profiled ramp surface 28 of the whipstock 44. The taper of surface 43 may be in the range of 1 to 15 degrees. A final full gage cutting surface 53 extends vertically above medial cutting surface 43 and is parallel to the axis 29. The opposite end of the whipstock is secured to a, for example, hydraulically actuated anchor (not shown). A typical anchor is shown in U.S. patent application Ser. No. 572,592 filed Dec. 14, 1995, incorporated herein by reference.

The assembly 30 is lowered into cased borehole 9 to a predetermined depth, the whipstock 44 is then rotated to a desired sidetrack direction followed by hydraulically actuating he anchor (not shown) by directing drilling fluid or "mud" down the drill string 12 under high pressure through flex conduit 37 connected to a coupling 57 on the end of the window mill 32. Coupling 57 includes a weakened area therearound such as a reduced diameter portion allowing coupling 57 to break cleanly from the mill 32. The pressurized fluid then enters conduit 50 formed in the whipstock 44 and from there to a connecting member 19 and then to the anchor to extend the pipe gripping elements within the anchor (not shown).

The backside 62 of the whipstock 44, especially adjacent the end 61 of the whipstock 44, is contoured to conform to the inside diameter of the pipe casing 11, for stability of the top of the whipstock 44.

The whipstock 44 includes a profiled ramp surface 28 having a curved or arcuate cross section and multiple surfaces, each forming its own angle with the axis 26 of whipstock 44. Profiled ramp surface 28 includes a starter surface 45 having a steep angle preferably 15°, a vertical surface 46 preferably parallel to the axis 26, an initial ramp surface 47 having a standard angle preferably 3°, a "kick out" surface 48 having a steep angle preferably 15°, and a subsequent ramp surface 49 having a standard angle preferably 3°. It should be appreciated that these angles may vary. For example, the starter ramp surface 45 may have an angle in the range of 1 to 45 degrees, and preferably in the range of 2 to 30 degrees, and still more preferably in the range of 3 to 15 degrees, and most preferably 15 degrees. The vertical surface 46 has a length approximately equal to or greater than the distance between mills 32 and 33.

When the window mill 32 is full gage, the "kick out" ramp surface 48 begins at that point on the initial 3° ramp surface 47 where the thickness of the ramp surface 47 is approximately equal to the radius of the whipstock 44. In other words, the radial distance between that point on surface 47 and the inside diameter of the wall of the casing 11 should be approximately the same or slightly longer than the radius of the window mill 32. This ensures that "kick out" ramp surface 48 will increase the rate of deflection of the window mill 32 just before the center 25 of window mill 32 reaches the inside diameter of the wall of the casing 11. The "kick out" ramp surface 48 forms an accelerator ramp which exerts a lateral force to the window mill 32 and greatly increases the rate of deflection of the window mill 32 into the wall of the casing 11. Although the preferred angle of "kick out" surface 48 is 15 degrees, the angle may be from 10 to 45 degrees. It should be appreciated that the kick out ramp surface 48 may be used in constant angle whipstocks such as a whipstock having a standard ramp surface of, for example, 2 to 3 degrees, with the "kick out" ramp surface having a substantially greater ramp angle located at approximately the mid-whip position of the whipstock thereby creating a jog or deviation in the otherwise constant angle of the whipstock. The use of the "kick out" ramp surface 48 allows the design of the window mill 32 to incorporate a lighter dressing which will increase formation ROP.

Figure 4:
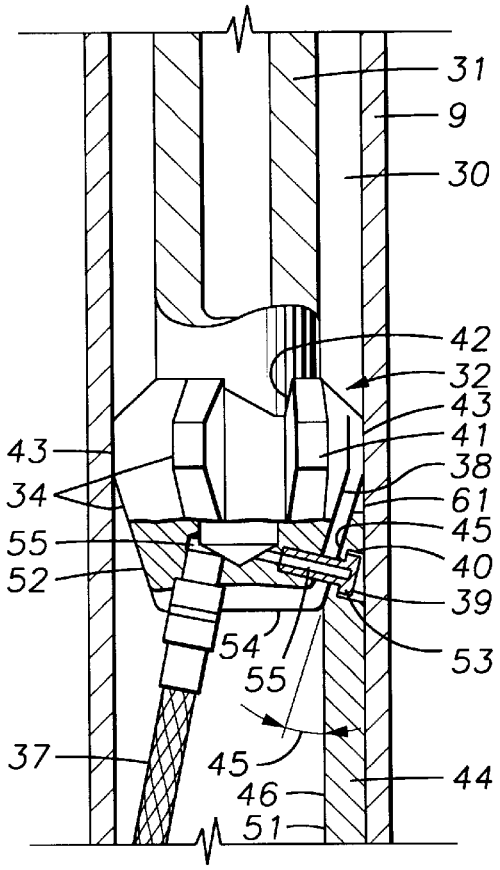
FIG. 4 is an enlarged partial cross-section of the tapered window mill illustrating the hollow shear pin attaching the tapered window mill to the parallel ramped surface formed adjacent the top of the whipstock.
Figure 5:
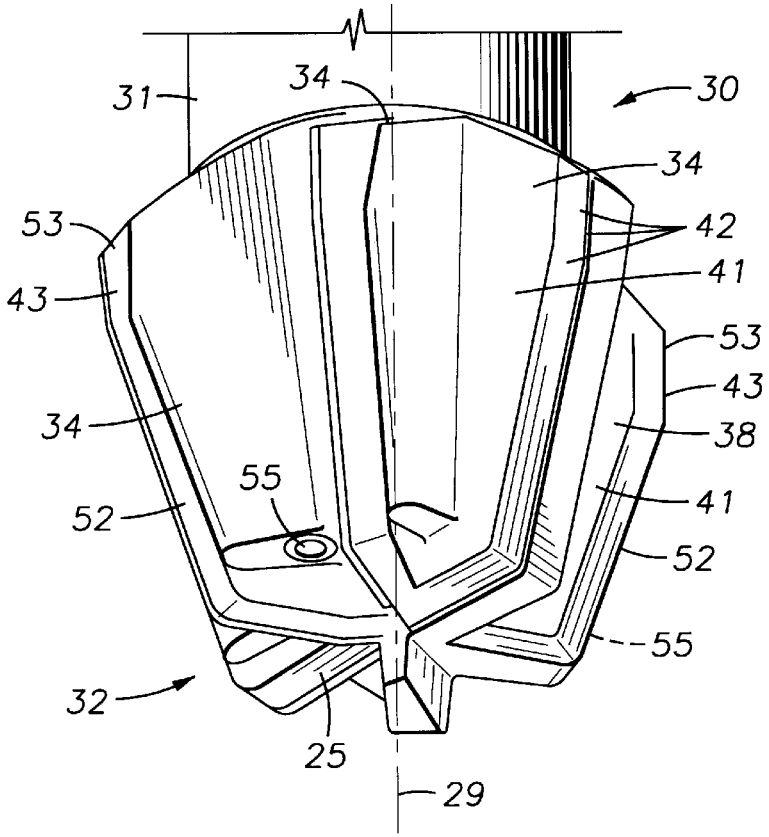
FIG. 5 is a perspective view of the tapered window mill with chip breaking cutter elements attached to the cutting face of each blade of the window mill.
Figure 6:
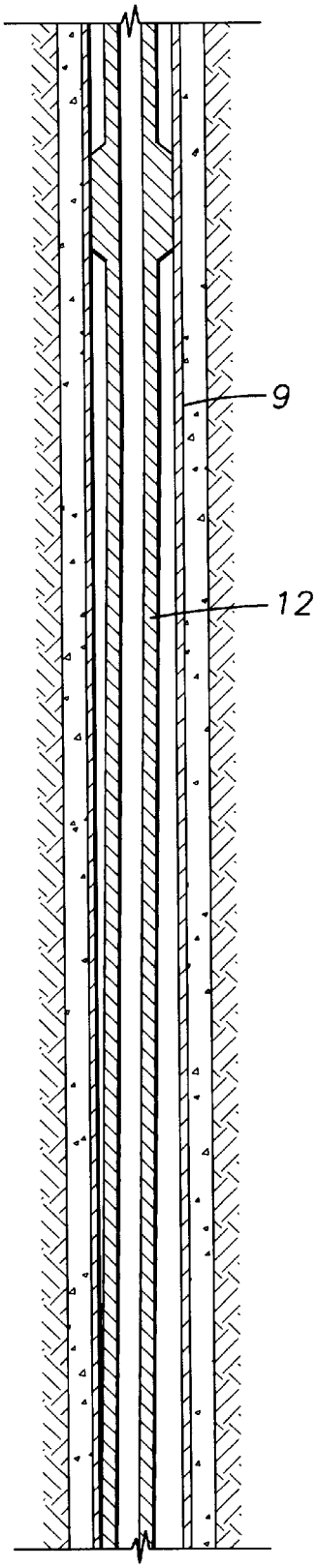
FIGS. 6A and B and are partial cross-section of the one trip sidetrack window cutting apparatus wherein the mill is sheared from the top of the whipstock and is moved laterally through the casing by 15° ramp angle formed in the top of the whipstock.

Referring now to the enlarged FIG. 4, once the anchor is set, further sufficient tension forces imparted to the drill string breaks the shear pin 39 freeing the tapered window mill 32. The relatively steep profiled angle (15 degrees) formed in surface 45 of the whipstock 44 immediately provides a lateral force to the tapered end 52 of the mill 32 thus forcing the rotating mill 32 into the interior of the wall of the pipe casing 11 to start forming a first window 20A in the pipe casing 11. The upstream second mill 33, which may be tear drop in shape, is also forced into the wall of the pipe casing 11 thereby simultaneously cutting a second window 20B above the first window 20A formed by the window mill 32. The surface 46 formed by the whipstock 44 below angled surface 45 is preferably parallel to the axis of the pipe casing 11 while the window mill 32 and the second mill 33 cut simultaneous windows 20A and B (FIG. 6).

Surface 45 is heavily hardfaced with, for example, a composite tungsten carbide material 51 metalurgically applied to the ramp surface. One preferred hardfacing is Colmonoy 88 manufactured by Wall Colmonoy and has a hardness of RC 58–64. Moreover, the entire profiled ramp surface 28 of the whipstock 44, exposed to the cutting action of the mills, may be hardfaced.

The perspective of the tapered window mill 32 consists of blades 34, each blade having, for example, a multiplicity of cutting elements such as tungsten carbide cutters 42 with "chip breakers" formed on the face of the cutters. The chip breakers on the face of each cutter serves to break up the curled cuttings resulting from the window mill 32 cutting through the pipe casing 11 so that the cuttings may be transported up the drill string annulus by the mud circulated through the drill string. Without the chip breaker, the continuous cuttings create a "rats nest" downhole and cannot be easily removed.

These highly effective cutters are manufactured by Rogers Tool Works, Rogers, Arkansas and are known as Millmaster.

It would be obvious to utilize natural or polycrystalline diamond cutters (not shown) on the cutting blades 34 of the tapered window mill 32 without departing from the spirit of this invention.

Blade 38 immediately adjacent the parallel surface 45 of whipstock 44 is preferably wider to accommodate the shear bolt 39 threaded into the blade 38. The head of the shear bolt 53 is seated in the end of the whipstock 61 and the threaded shank 54 is threaded into blade 38. The shank 54 of the shear bolt is preferably hollow so that, once the bolt 39 is sheared, the shank 54 serves as a nozzle extension for nozzles 55 positioned at the base of shank 54 and at the entrance to conduit 37 that directs fluid to the whipstock anchor (not shown).

It would be obvious however to utilize a shear bolt with a solid shank without departing from the scope of this invention.

Figure 7:
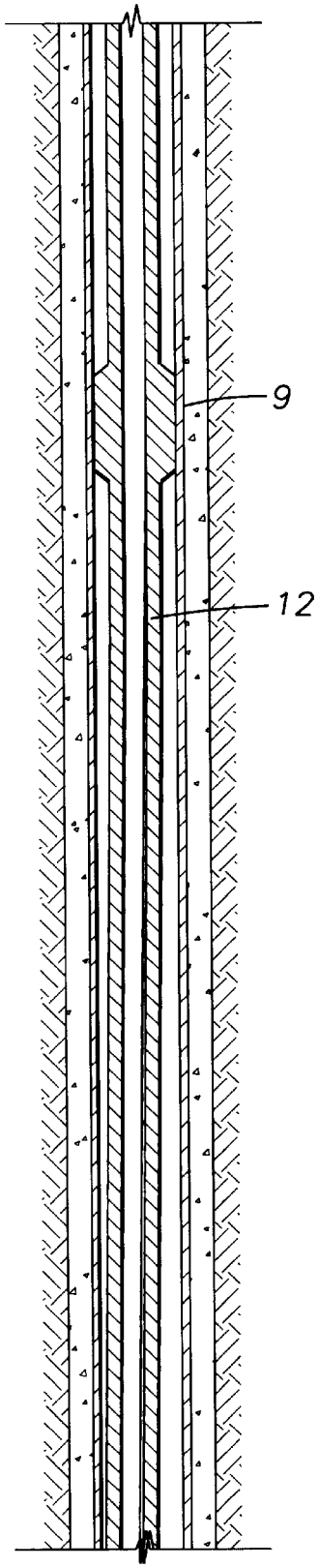
FIGS. 7A and B are a partial cross-section of the window mill and upstream "tear drop" cutter cutting the window in the pipe casing. The ramp section immediately below the 150 ramp formed in the whipstock is parallel to the axis of the pipe casing while the tear drop cutter completes its initial cut in the window from its entry into the casing to its intersection with the cut made by the tapered window mill.

With specific reference to FIG. 7, once the upstream window 20B (cut by the second mill 33) merges with the downstream window 20A started by the window mill 32, cutting forces are lessened. The ramp surface 47 formed by the whipstock 44 below the parallel surface 46 then transitions into a ramp with a 3° angle.

Figure 8:
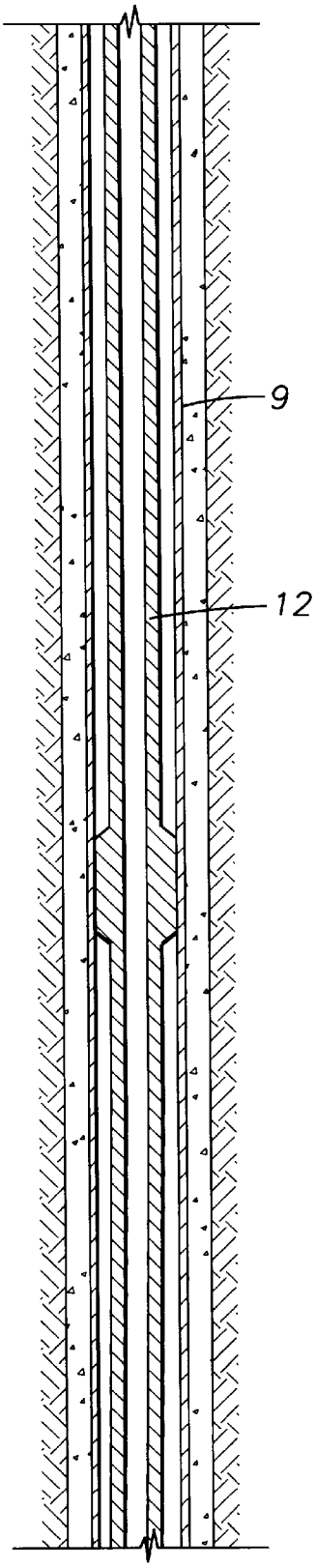
FIGS. 8A and B are is a partial cross-section of the window mill contacting a second "kick out" ramp formed in the 3° ramp portion of the whipstock, the kick out ramp serves to force the window mill out of the casing so that it will complete the window more efficiently.
Figure 6B:
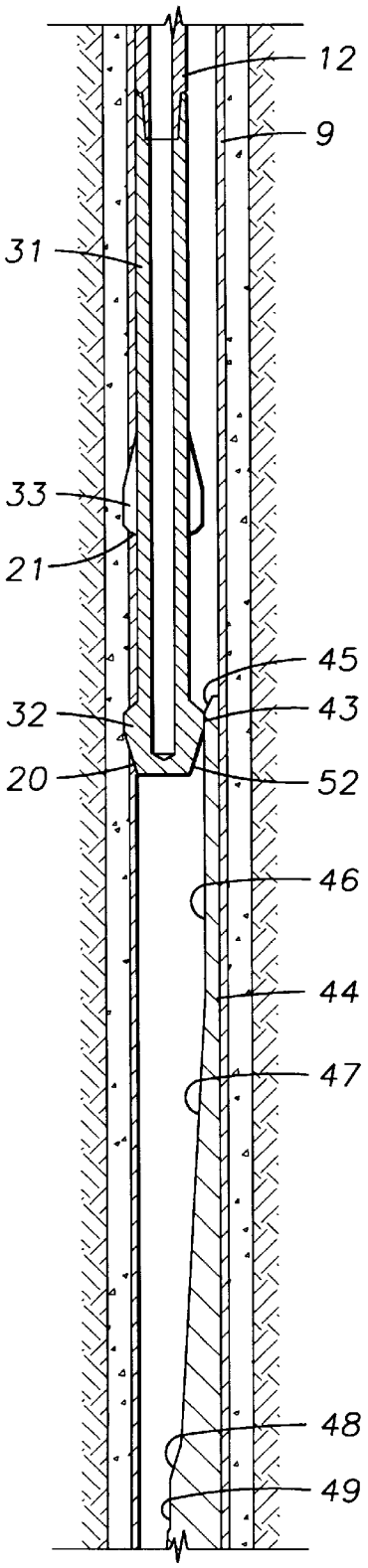
Figure 7B:
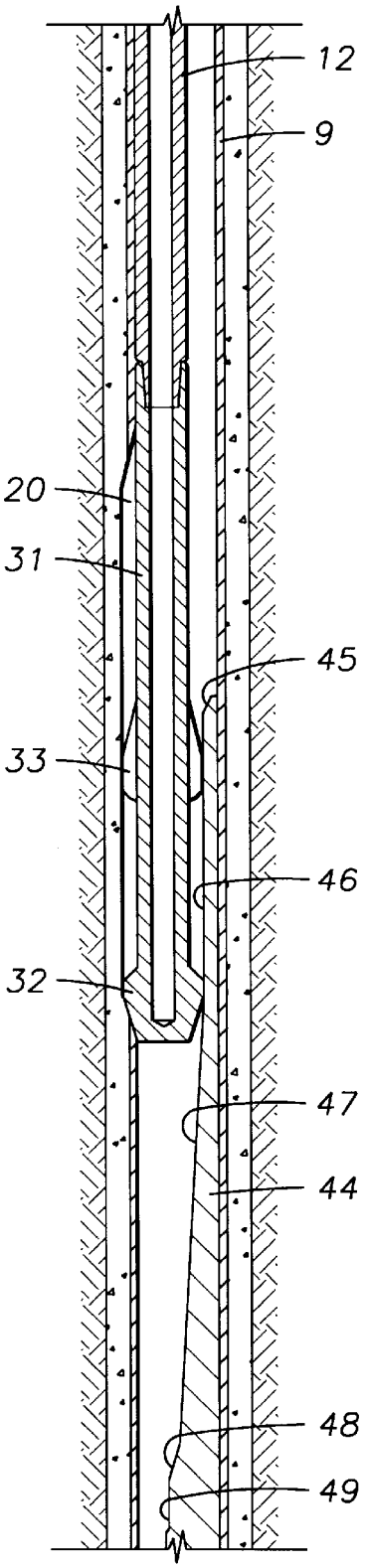
Figure 8B:
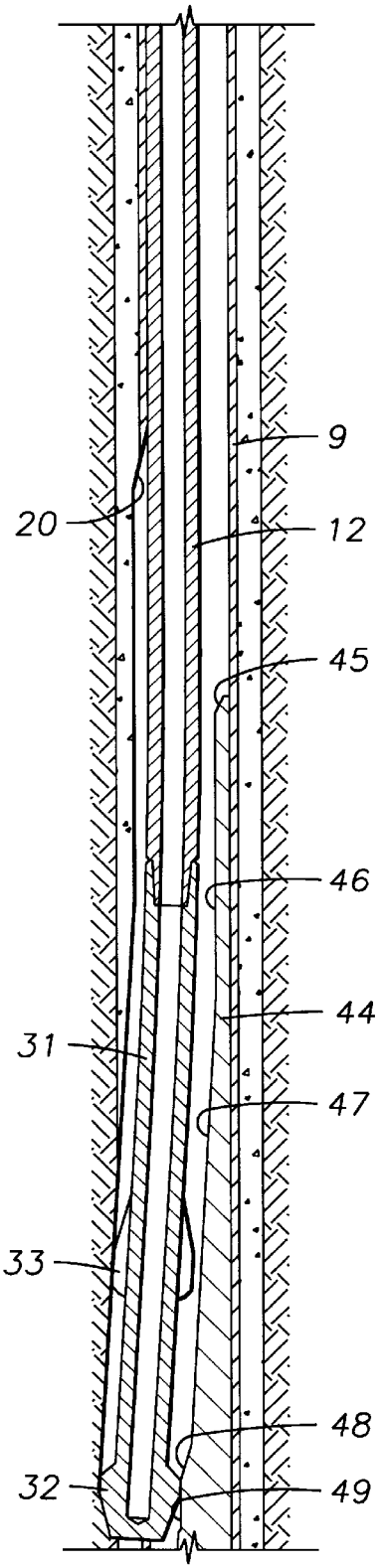

Referring now to FIG. 8, when the center of the window mill 32 starts cutting at the inside diameter of the wall of the casing 11 as the window milling apparatus progresses down the whipstock 44 and out through the window 20 cut into the pipe casing 11, the cutting or pipe milling action is slowed considerably. At this point the "kick out" ramp 48 (15° as compared to the 30 ramp surface 47) "kicks" the window mill 32 out through the casing 11 for more efficient milling of the casing 11. Once past this part of the window milling process is overcome, the ramp 49 below the kick out ramp 48 reverts back to the standard 3° ramp angle surface 49.

Figure 9A:
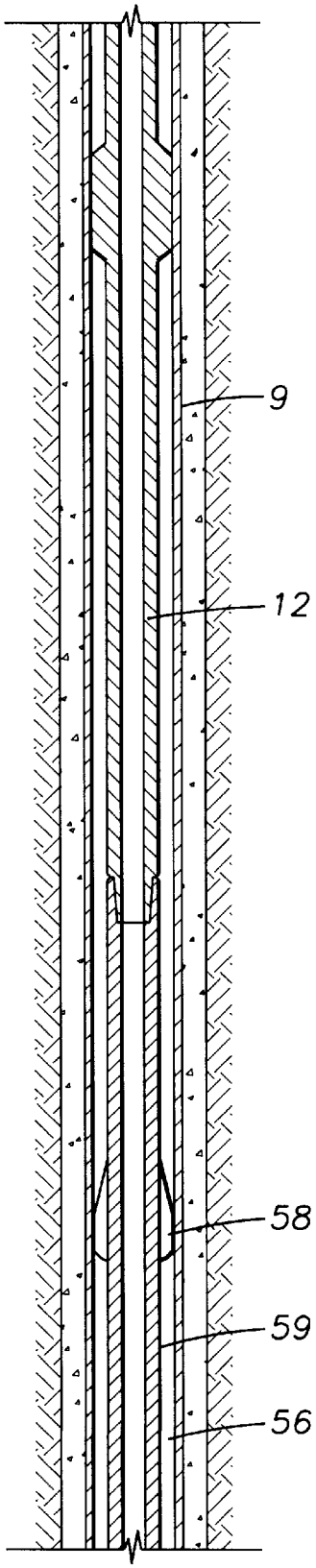
FIGS. 9A and B are a partial cross-section of an alternative window cutting apparatus identical to the apparatus shown with respect to FIGS. 6 through 8 with the exception of a "watermelon" mill positioned upstream of the tear drop mill.
Figure 9B:
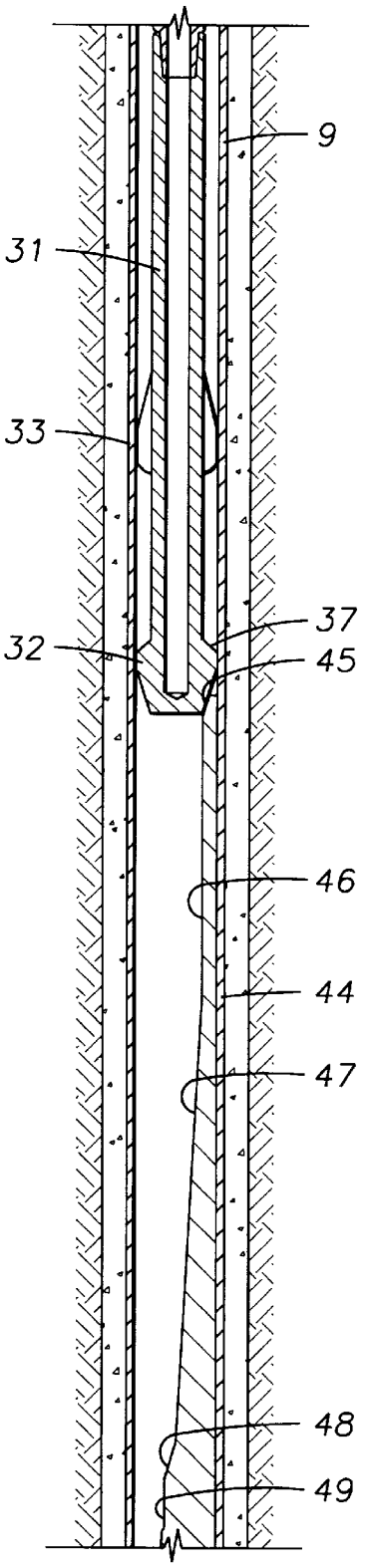

An alternative embodiment is illustrated in FIGS. 9 through 12. A second subassembly generally designated as 56 is positioned intermediate mill assembly 30 and the drill string 12. A third mill 58, such as a watermelon mill, is spaced between the male and female ends of the shank or shaft 59 (FIG. 9).

Figure 10A:
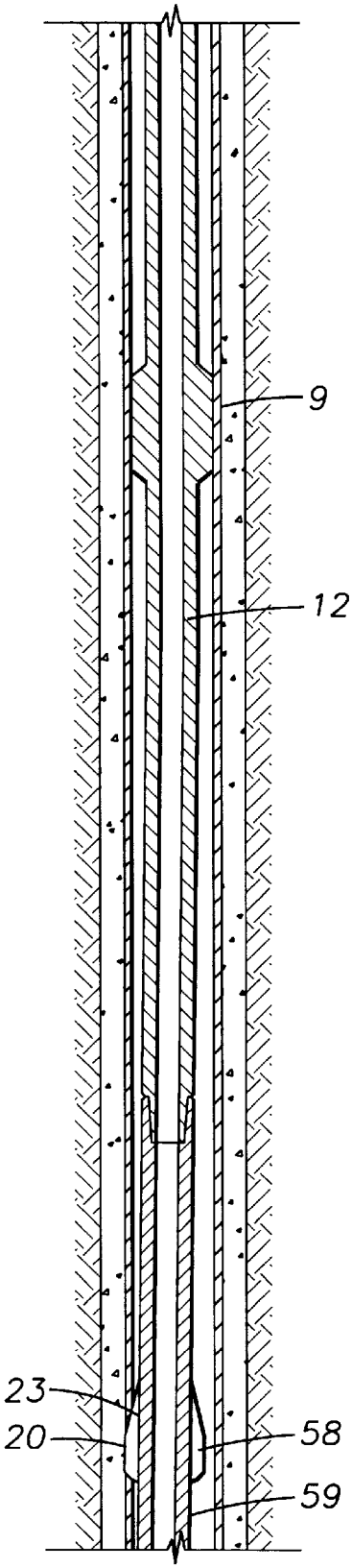
FIGS. 10A and B are a partial cross-section of the alternative apparatus illustrating the watermelon mill starting its cut into the pipe casing above the window started by the downstream mills.
Figure 10B:
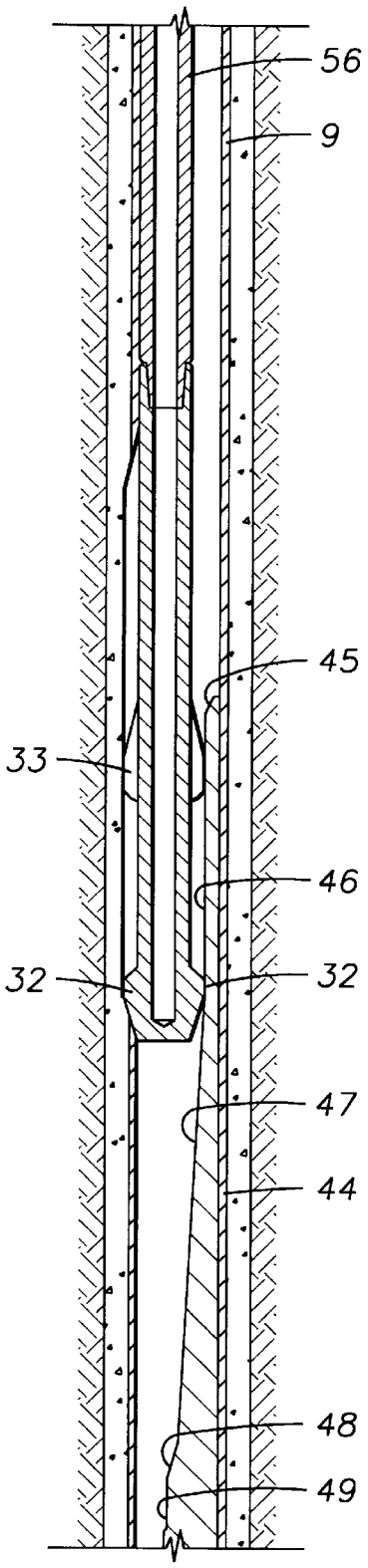

FIG. 10 illustrates the third mill 58 having generally the same diameter as the window mill 32 and second mill 33 and serves to both lengthen the window 20 penetrating the casing 12 above the window 20 cut by the window and second mills 32, 33. It is preferred that all three mills 32, 33 and 58 be full gage.

Figure 11A:
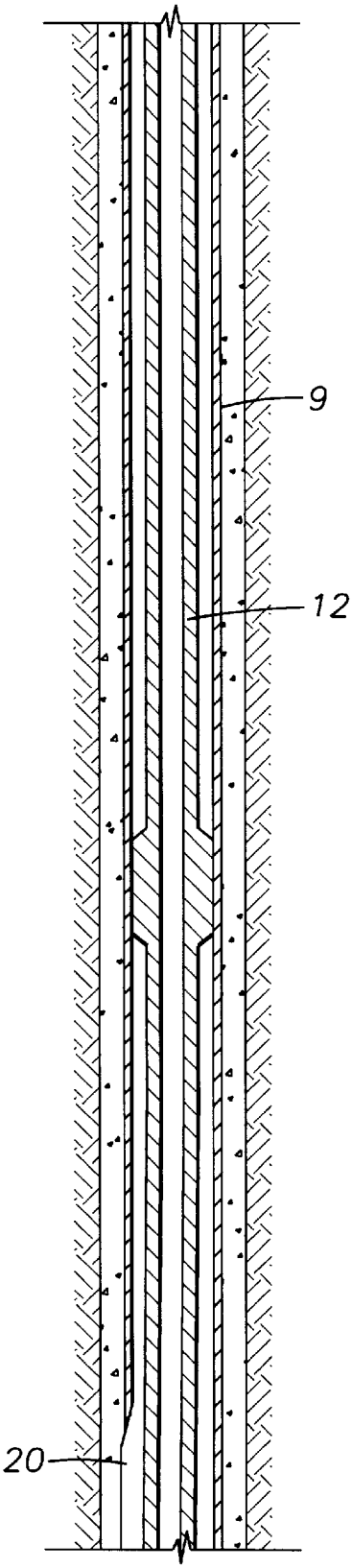
FIGS. 11A and B are a partial cross-section of the alternative apparatus after the window, tear drop and watermelon mills have cut an elongated window in the casing.
Figure 11B:
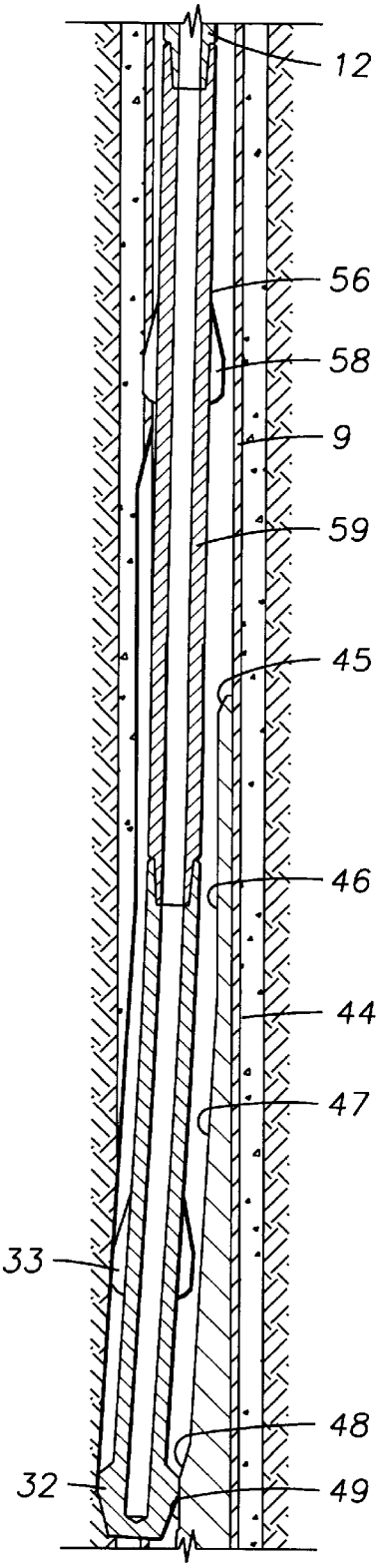

The third mill 58 also serves to dress the window opening 20 as shown in FIG. 11 for easy transition of the following side track drill bit assembly.

The elongation of the window 20 by the watermelon mill 58 is desirable to facilitate sidetracking drill bit assemblies that are relatively stiff and the angle of the side track borehole is slight. A longer window then would be necessary.

Where the side track angle is more severe and the drill bit side track assembly is relatively limber, a shorter window will suffice and the watermelon assembly 56 is omitted from the window cutting apparatus as is shown with respect to FIGS. 3 through 8.

Upon assembly, mill assembly 30 is connected to whipstock assembly 60 by shear bolt 39 with the lower tapered end 52 of window mill 32 being engagingly disposed against starter surface 45. Further, hydraulic hose 37 is connected to assemblies 20, 30.

In operation, the whipstock assembly 20 and mill assembly 30 are connected to the lower end of a drill string 12 and lowered into cased borehole 9 as shown in FIGS. 9A and B. Once the desired depth is reached for the secondary or deflection bore, the whipstock assembly 20 is aligned and oriented within the cased borehole 9 and the anchor is set thereby anchoring the whipstock assembly 20 within the cased borehole 9 at the desired location and orientation. Tension is then pulled on drill string 12 to shear shear bolt 39.

The mill assembly 30 is then rotated and lowered on the drill string 12. The complimentary lower tapered end 52 on the rotating window mill 32 cammingly and wedgingly engages starter surface 45 on whipstock 44 thereby causing the window mill 32 to kick out and engage the wall of the casing 11 thereby forcing the cutting elements 34 into milling engagement. As the window mill 32 rotates and moves downwardly, the window mill 32 continues to be deflected out against the wall of the casing 11 and eventually punches through the wall of the casing 11. It is important that the starter surface 45 and its center line match that of the initial surface 52 on the window mill 32. The angle of tapered end 52 and starter surface 45 may be up to 45°.

Once initial punch out has been achieved, weight on the drill string 12 is required to push the window mill 32. It is the "punch through" of the window mill 32 that is the most important cutting. Once the window mill 32 punches through the wall of the casing I 1, a ledge is created allowing the whipstock 44 to then guide the mill assembly 30 through the window 20 cut in the wall of the casing 11.

This initial guidance of the starter surface 45 and the hard facing 51 ensures that the whipstock 44 is not damaged by the window mill 32 and that the window mill 32 properly initiates the required window cut. It is important to deflect the window mill 32 away from the ramp surface 20 of the whipstock 44 to avoid the window mill 32 from milling the whipstock 44.

Referring now to FIGS. 10A and B, once the initial punch out is made through the wall of the casing 11 by the window mill 32, the window mill 32 has past the starter surface 45 and is adjacent the straight surface 46 which allows the mill 32 to run along a straight track. Once the window mill 32 moves past the starter surface 45, window mill 32 continues to mill the wall of the casing II while the second mill 33 expands the window in the wall of the casing 11 previously cut by the window mill 32. As the second mill 33 follows behind the window mill 32 and begins to cut into the wall of the casing 11, there is formed an uncut portion of the casing 11 between the two mills 32, 33 which has not yet been milled. As the window mill 32 is lowered downwardly adjacent to straight surface 42, the second mill 33 cuts the unmilled portion of casing 11 which extends between mills 32, 33.

If the second mill 33 is deflected into the casing 11, then that portion of tubular member 27 between the window mill 32 and pilot mill 33 may engage the uncut portion of the casing wall which has not yet been milled out. If the window mill 32 maintains the steep angle of the starter surface 45, it is possible that that portion will engage the uncut portion of the wall of the casing 11 and prevent the mills 32, 33 from cutting the wall of the casing 1l. It is possible that the mill assembly 30 could bind and hinder further milling. This is prevented by straight surface 46 which has a height substantially equal to or greater than the distance between mills 32 and 33.

Upon the window mill 32 moving past the straight surface 46, any uncut portion of the casing wall between the mills 32, 33 has now been cut by the second mill 33. At this point, the medial surface 43 of window mill 32 engages the ramp surface 47 and the window mill 32 is again deflected outwardly against the wall of casing 11 to enlarge the window 20 and is guided by the surface 47 into the wall of the casing 11 without causing any damage to the whipstock 44. Now that the window mill 32 has punched through the wall of the casing 11, it begins cutting into the cement. The second mill 33 is now passing along the straight surface 46 and cutting the window 20 that has already been started by the window mill 32 to make the window wider. As can be appreciated, watermelon mill 58, following the second mill 33, also begins cutting and widening the window 20 through casing 11. There may be one or more additional watermelon mills above the first watermelon mill 58. The purpose of the watermelon mills is to elongate the top of the window 20 in the casing 11 and clean up the window 20 particularly if there has been a ledge created.

Referring now to FIGS. 11A and B, upon completing the milling along the surface 47, the casing wall will be underneath the window mill 32 and the center 25 of the window mill 32 is approaching the inside diameter of casing 11. At this point, the window mill 32 engages kick out surface 48 to assist the crossing of the wall of the casing 11. The steeper angle on surface 48 causes the center 25 of window mill 32 to more quickly kick out and radially pass from the inside diameter to the outside diameter of the wall of casing 11. The second mill 33 and watermelon mill 58 are following and expanding and clearing the window in the wall of the casing 11. The mill assembly 30 drills faster into the formation once the window mill 32 completely passes the cased wall and into the formation.

The kick out wedge surface 48 is a second steep surface to assist in moving the window mill 32 from the inside diameter to the outside diameter of the wall of the casing 1. When the center line 25 of the window mill 32 is sitting on the wall of the casing 11, the window mill 32 is essentially at zero rotation. The purpose for the kick out surface 48 is to reduce the drilling time required to cross the wall of the casing 11. The increased angle of surface 48 allows the window mill 32 to move quickly across the wall of casing 11. By increasing the angle between window mill 32 and whipstock 44, the cutting distance of the window mill 32 is shortened for the center line 25 of the window mill 32 to cross the wall of the casing 11.

Further, additional weight can be applied to the drill string 12 to increase the force on the window mill 32 and to cause the center line 25 of the window mill 32 to cross the casing wall more quickly. Once the center line 25 of the window mill 32 crosses the wall of the casing 11, the window mill 32 goes back to the final three degree surface 49 departure to exit. This reduced drilling time and distance allows significant savings.

Upon the window mill 32 moving past the kick out surface 48, the center line 25 of window mill 32 has passed outside of the wall of the casing 11 and is creating a diverted path to form a side track through the wall of the casing 11 and a window borehole in the formation. At this point, the medial surface 43 of window mill 32 engages the lower surface 49 of ramp surface 20 and the window mill 32 is deflected laterally to drill the window borehole. The window mill 32 is now being guided by the lower surface 49 into the formation. The window mill 32 in effect drills the window borehole for the drill bit so that the drill bit can get a faster start in drilling the new borehole.

The window 20 is cut substantially the entire length of the whipstock 44. Once the milling or cutting of the window is completed, the drill string 12 and mill assembly 30 are replaced by a standard drilling apparatus for drilling the new borehole.

Figure 12:
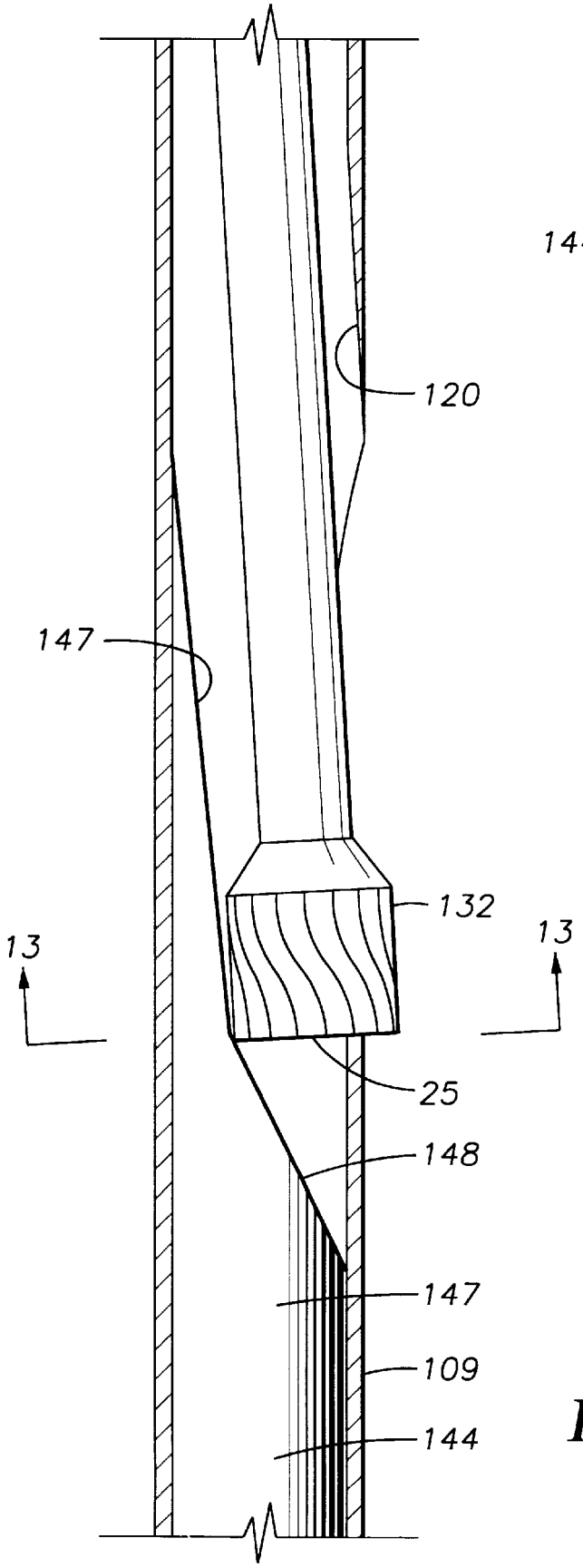
FIG. 12 is a partial cross-section of an alternative whipstock with a "kick out" ramp in the 3° ramp portion.
Figure 13:
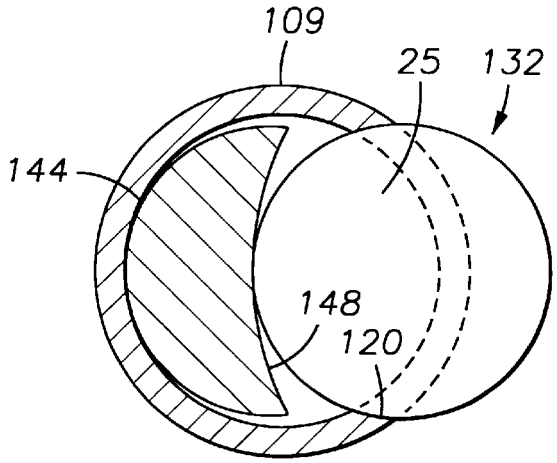
FIG. 13 is a view taken through 13—13 of FIG. 12.

Turning now to the alternative embodiments of FIGS. 12 and 13, a whipstock generally designated as 144 has, formed on its 3° ramp surface 147, a kick out ramp 148.

The aggressive angle of the ramp 148 formed in the whipstock guide surface 147 enables the conventional window mill cutter 132 to quickly move beyond that part of the milling process which occurs when the center 25 of the mill 132 is passing over the wall of the casing 109 as heretofore described.

FIG. 13 illustrates the window mill 132 passing over the wall of the casing 109 as it progresses through window 120. The window mill 132 need not have a tapered end as does mill 32 in the embodiment of FIGS. 1–11. This mill 132 may have a leading end with an angle in the range of 0 to 45 degrees.

The ramp angles for ramps 45, 48 and 148 may be from 1 to 45° with respect to the axis of the whipstocks 44 and 144 without departing from the scope of this invention.

Moreover, where parallel surfaces are mentioned such as blade surface 52 formed by tapered mill 32 and ramp surfaces 45, 48 and 148 formed by whipstock 44, these surfaces are considered "substantially" parallel when such surfaces are less than 3° from being exactly parallel.

It should also be noted that the pipe casing 11 lining the borehole 9 may be other than steel.

Moreover, there may not be any casing lining the borehole 9. Many of the unique features of this invention set forth above will still be advantageous in successfully drilling a deviated borehole in an existing earth borehole.

It will of course be realized that various modifications can be made in the design and operation of the present invention without departing from the spirit of the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed:

1. A side track cutting apparatus for cutting a secondary borehole through the wall of an existing borehole, comprising:

a cutting tool affixed to the end of a shaft, the cutting tool having a tapered cutting surface forming a cutting angle; and a whipstock having a ramp with a ramp angle substantially the same as the cutting angle of the tapered cutting surface, said ramp having a range of thickness deflecting the center of the cutting tool into the wall of the existing borehole to drill the secondary borehole.

2. A one trip side track window cutting apparatus for cutting sidetracking windows in a pipe casing positioned in previously drilled boreholes comprising;

a window cutting mill affixed to an end of a shaft, a body of the mill with a tapered cutting end forming a cutting angle; and a whipstock having an axis and a ramp forming a ramp angle, the ramp angle substantially parallels the cutting angle of the tapered cutting end of the window mill, said ramp acting as a bearing surface for laterally forcing the center of the window mill from the interior to the exterior of the pipe casing.

3. The apparatus of claim 2 wherein the ramp angle is in the range of 1 to 45 degrees with respect to the axis of the whipstock.

4. The apparatus of claim 2 wherein the ramp angle is in the range of 2 to 30 degrees with respect to the axis of the whipstock.

5. The apparatus of claim 2 wherein the ramp angle is in the range of 3 to 15 degrees with respect to the axis of the whipstock.

6. A one trip side track window cutting apparatus for cutting sidetracking windows in a pipe casing having an inside and outside diameter and positioned in previously drilled boreholes comprising;

a window cutting mill having a radius and being affixed to a first shaft, a body of the mill having a tapered cutting end forming a cutting angle, and a whipstock having an end and a ramp adjacent to said end with a ramp angle, the ramp angle substantially parallels the cutting angle of the tapered cutting end of the window mill, said ramp angle causing said ramp to have a reduced thickness adjacent said end and increasing in thickness to an enlarged thickness, said reduced thickness and radius approximating the inside pipe diameter, whereby the ramp laterally forces the window mill into the pipe casing initiating the cutting of the window, said enlarged thickness and radius being larger than the outside pipe diameter causing the window mill to cut a window in and through the pipe casing, the ramp acting as a bearing surface during the window cutting operation.

7. A one trip side track window cutting apparatus for cutting sidetracking windows in a pipe casing positioned in previously drilled boreholes comprising:

a substantially full gage window cutting mill affixed to a first shaft, a body of the mill with a tapered cutting end forming a cutting angle, and a whipstock having a ramp adjacent to an end with a ramp angle, the ramp angle substantially parallels the cutting angle of the tapered cutting end of the window mill commencement of the window cutting process in the pipe casing results in the angled whipstock ramp laterally forcing the window mill into and through the pipe casing, the ramp acting as a bearing surface during the initial window cutting operation;

a second mill affixed to another shaft attached to said first shaft, the second mill being spaced upstream of the window mill, the second mill substantially simultaneously cutting into the pipe casing when the window mill is laterally directed into the pipe casing.

8. The apparatus as set forth in claim 1 wherein the whipstock forms a non-angled ramp surface below the angled ramp of the whipstock that is substantially parallel to the axis of the whipstock, the non-angled whipstock ramp surface allowing the window mill and the second mill to each simultaneously cut a portion of a window, when that portion of the window cut by the second mill window merges with that portion of the window cut by the window mill, the parallel ramp surface transitions into a slightly angled ramp to further direct the window mill and the second mill into the pipe casing.

9. A one trip side track window cutting apparatus for cutting sidetracking windows in a pipe casing positioned in previously drilled boreholes comprising;

a substantially full gage window cutting mill affixed to a first shaft, a body of the mill with a tapered cutting end forming a cutting angle, and a whipstock having a ramp adjacent to an end with a ramp angle, the ramp angle substantially parallels the cutting angle of the tapered cutting end of the window mill, commencement of the window cutting process in the pipe casing results in the angled whipstock ramp laterally forcing the window mill into and through the pipe casing, the ramp acting as a bearing surface during the initial window cutting operation;

a second mill mounted to said first shaft as the window mill.

10. The apparatus as set forth in claim 9 wherein the diameter of the second mill is about the same as the diameter of the window mill.

11. The apparatus as set forth in claim 9 further comprising a third mill affixed to the shaft, the third mill being spaced from the second mill and serving to elongate the window cut by the window mill and the second mill, the third mill also serving to dress the window formed in the pipe casing.

12. The apparatus as set forth in claim 11 wherein the third mill is a watermelon shaped mill with about the same diameter as the window mill and the second mill.

13. A whipstock for guiding a cutting tool within an existing borehole, comprising:

a body having an axis;

a guide surface on said body adapted for guiding engagement with the cutting tool; and said guide surface including a first taper with a first angle to said axis adjacent an end of said body and a second taper with a second angle to said axis adjacent a medial portion of said body, said first angle being greater than said second angle.

14. The whipstock of claim 13 wherein said first angle is more than twice said second angle.

15. The whipstock of claim 13 wherein said guide surface includes surface hardening.

16. The whipstock of claim 13 wherein said body has a curvature on its exterior which substantially conforms to the curvature of the interior of the casing.

17. A whipstock for guiding a cutting tool within a casing, comprising:

a body having an axis;

a guide surface on said body adapted for guiding engagement with the cutting tool: and said guide surface including a first taper with a first angle to said axis and a second taper with a second angle to said axis;

said guide surface including a third taper with a third angle to said axis.

18. The whipstock of claim 17 wherein said guide surface includes a fourth taper with a fourth angle to said axis.

19. The whipstock of claim 18 wherein said guide surface includes a fifth taper with a fifth angle to said axis.

20. The whipstock of claim 19 wherein said first and fourth angles are substantially equal.

21. The whipstock of claim 20 wherein said third and fifth angles are substantially equal.

22. The whipstock of claim 19 wherein said first and fourth angles are substantially fifteen degrees, said second angle is substantially zero degrees, and said third and fifth angles are substantially three degrees.

23. A whipstock for guiding a cutting tool within a casing, comprising:

a body having an axis:

a guide surface on said body adapted for guiding engagement with the cutting tool, and said guide surface including a first taper with a first angle to said axis and a second taper with a second angle to said axis:

one of said first and second angles being substantially zero degrees to said axis and therefore is substantially parallel with said axis.

24. A whipstock for guiding a cutting tool within a casing, comprising:

a body having an axis;

a guide surface on said body adapted for guiding engagement with the cutting tool; and said guide surface including a first taper with a first angle to said axis and a second taper with a second angle to said axis:

said first angle being more than twice said second angle:

said first angle being five times that of said second angle.

25. An apparatus for cutting a window in a casing disposed within a well, comprising:

a cutting assembly having a cutting assembly axis and including a first cutting member with a first bearing surface forming a first bearing angle with said cutting assembly axis;

a guide member having a guide member axis and a guide surface, said guide surface including a first tapered wedge surface having a first angle with said guide member axis and a second surface having a second angle with said guide member axis, said first angle being greater than said second angle and being substantially the same as said first bearing angle;

said first bearing surface engaging said first tapered wedge surface for deflecting said first cutting member and then said first bearing surface engaging said second surface for guiding said cutting assembly.

26. The apparatus of claim 25 wherein said first cutting member includes a third bearing surface for cutting full gage.

27. The apparatus of claim 26 wherein said third bearing surface is parallel to the axis of the cutting assembly.

28. The apparatus of claim 25 wherein said first bearing angle is in the range of 1 to 45 degrees with respect to the axis of the cutting assembly.

29. An apparatus for cutting a window in a casing disposed within a well, comprising:

a cutting assembly having a cutting assembly axis and including a first cutting member with a first bearing surface forming a first bearing angle with said cutting assembly axis;

a guide member having a guide member axis and a guide surface, said guide surface including a first tapered wedge surface having a first angle with said guide member axis and a second surface having a second angle with said guide member axis;

said first bearing surface engaging said first tapered wedge surface for deflecting said first cutting member and then said first bearing surface engaging said second surface for guiding said cutting assembly;

said first cutting member having a second bearing surface forming a second bearing angle with said cutting assembly axis.

30. The apparatus of claim 29 wherein said second bearing angle has substantially the same angle as said second angle.

31. The apparatus of claim 29 wherein said second bearing angle is in the range of 0 to 45 degrees with respect to the axis of the cutting assembly.

32. The apparatus of claim 29 wherein said cutting assembly further includes a second cutting member disposed a predetermined distance from said first cutting member.

33. The apparatus of claim 32 wherein said guide surface includes a non-tapered surface adjacent said first tapered wedge surface, said non-tapered surface having a length substantially equal to or greater than said distance between said first and second cutting members.

34. The apparatus of claim 32 wherein said second cutting member cuts full gage.

35. The apparatus of claim 32 wherein said cutting assembly includes a third cutting member disposed a predetermined length from said second cutting member.

36. A method of drilling a window in a casing disposed in a well comprising:

releasably connecting a starter cutting member to one end of a whipstock;

engaging a first bearing surface on the starter cutting member with an initial wedge surface on the whipstock;

disposing the starter cutting member and whipstock within the casing;

disconnecting the starter cutting member from the whipstock;

deflecting the starter cutting member into engagement with the casing;

engaging a second bearing surface on the starter cutting member with a subsequent wedge surface on the whipstock; and passing the center of the starter cutting member from the interior to the exterior of the casing.

37. The method of claim 36 wherein the deflecting step includes paralleling the first bearing surface of the starter cutting member with the initial wedge surface on the whipstock.

38. A method of drilling a window in a casing disposed in a well comprising the steps of:

lowering a milling assembly releasably connected to a whipstock assembly into the casing;

anchoring the whipstock assembly within the casing;

disconnecting the milling assembly from the whipstock assembly;

lowering and rotating the milling assembly having at least two full gage cutting members;

engaging a bearing surface on one of the cutting members with an initial wedge surface on the whipstock of the whipstock assembly;

deflecting the one cutting member into engagement with the casing;

passing the one cutting member along a non-tapered surface of the whipstock until the second cutting member is adjacent the initial wedge surface;

guiding the one cutting member along a subsequent wedge surface on the whipstock until the center of the one cutting member is adjacent the interior wall of the casing;

engaging the one cutting member with a third wedge surface;

deflecting the one cutting member against the casing until the center of the one cutting member passes to the exterior of the casing; and guiding the one cutting member along a fourth wedge surface on the whipstock until the window is cut.

39. A mill for cutting a secondary borehole in an existing borehole comprising:

a body;

a plurality of cutting surfaces with at least one of said cutting surfaces having an angle with the axis of the body;

said one of said cutting surfaces including a bore for receiving a hollow breakable member whereby upon breaking said breakable member, said bore acts as a nozzle.

40. The mill of claim 39 wherein another one of the cutting surfaces includes a coupling bore with a coupling attached to said another one of the cutting surfaces at said coupling bore whereby upon milling off said coupling, said coupling bore acts as another nozzle.

41. The mill of claim 40 wherein said coupling includes a reduced portion therearound causing said coupling to mill cleanly from said mill.

42. A whipstock for deflecting a cutting tool into the wall of a casing, comprising:

a body; and a guide surface on said body adapted for engagement with the cutting tool, said guide surface having at least three different tapers varying the degree of deflection of the cutting tool as the cutting tool is lowered through the casing against said guide surface.

43. The whipstock of claim 42 wherein said guide surface includes a first, second and third taper, said second taper being disposed between said first and third tapers on said guide surface and said first and third tapers being greater than said second taper.

44. A mill for cutting a secondary borehole in an existing borehole comprising:

a body;

a plurality of cutting members disposed on said body;

a hollow breakable member protruding from said body adjacent said cutting members; and said hollow breakable member breaking as said mill progresses for cutting the secondary borehole to form a nozzle for fluids passing through the mill.

* * * * *